United States Patent [19]

Takemura

[11] Patent Number: 4,803,809

[45] Date of Patent: Feb. 14, 1989

[54] SINGLE SLIDING SASH WINDOW

[75] Inventor: Masami Takemura, Kurobe, Japan

[73] Assignee: Yoshida Kogyo K. K., Tokyo, Japan

[21] Appl. No.: 137,730

[22] Filed: Dec. 24, 1987

[30] Foreign Application Priority Data

Dec. 25, 1986 [JP] Japan ..... 61-198218[U]

[51] Int. Cl.[4] ..... E05D 15/06; E06B 1/04

[52] U.S. Cl. ..... 49/404; 49/406; 49/408; 49/458; 52/207

[58] Field of Search ..... 49/404, 406, 408, 425, 49/458; 52/207

[56] References Cited

U.S. PATENT DOCUMENTS

| | | | |
|---|---|---|---|
| 3,205,630 | 9/1965 | Felix et al. | 52/476 |
| 3,248,822 | 5/1966 | Sincock | 49/425 |
| 3,344,575 | 10/1967 | Grossman | 52/207 |
| 3,530,618 | 9/1970 | Grossman | 49/425 X |
| 3,774,360 | 11/1973 | Hubbard et al. | 52/127 |
| 4,286,716 | 9/1981 | Budich et al. | 49/425 X |
| 4,674,246 | 6/1987 | Giguere | 49/404 X |

FOREIGN PATENT DOCUMENTS 59-7503 3/1984 Japan .

*Primary Examiner*—Philip C. Kannan

*Attorney, Agent, or Firm*—Hill, Van Santen, Steadman & Simpson

[57] ABSTRACT

A single sliding sash window having a fixed sash and a movable sash includes an inverted L-shaped mounting flange formed integrally with the sill of a window frame and supporting thereon the fixed sash. One of opposed jambs of the window frame has a longitudinal guide groove sealingly receiving therein an abutment stile of the fixed sash. Upper and lower attachment members extend between the opposite jamb of the window frame and a meeting stile of the fixed sash and they are secured respectively to a head and the sill of the window frame by screws.

5 Claims, 4 Drawing Sheets

SINGLE SLIDING SASH WINDOW

BACKGROUND OF THE INVENTION

1. Field of the Invention

The present invention relates to a single sliding sash window having a fixed sash and a movable sash mounted within a window frame with the movable sash disposed on the exterior side of the window frame.

2. Description of the Prior Art

Japanese Utility Model Publication No. 59-7503 discloses a typical example of sliding sash window of the type having fixed and movable sashes mounted within a window frame.

The disclosed sliding sash window, as schematically reillustrated here in FIG. 5 of the accompanying drawings, includes a fixed sash b mounted centrally within a window frame a on the interior side thereof and two movable sashes c horizontally slidably mounted within the window frame on the exterior side thereof and disposed on opposite sides of the fixed sash b. The window frame A has two pairs of upper and lower attachment members f, f (only lower ones being shown) associated with a head and a sill, respectively, of the window frame a and extending between vertical pieces or jambs e, e of the window frame a and stiles d, d of the fixed sash b to hold the fixed sash b in position against horizontal displacement.

The sliding sash window of the foregoing construction is easy to assemble as the fixed sash is disposed centrally within the window frame. However, the same construction is not applicable in a single sliding sash window but requires an additional xpedient or measure for the assembly of the single sliding sash window wherein a fixed sash is mounted within a window frame in contact with an abutment jamb of the window frame.

The lower attachment member of the known sliding sash window is merely placed on the sill of the window frame and hence is likely to cause wobbling or sometimes removal from the window frame under shock forces applied when the window is opened and closed.

According to another sliding sash window disclosed in U.S. Pat. No. 3,248,822, a lower attachment member is directly secured by screws to the sill of a window frame. With this arrangement, water may intrude into the building frame through threaded holes in the sill, thereby significantly lowering the watertightness of the sliding sash window.

SUMMARY OF THE INVENTION

It is accordingly an object of the present invention to provide a single sliding sash window incorporating structural features which enable stable and firm attachment of a fixed sash to a window frame, and also enable firm attachment by screw fasteners of a lower attachment member to a sill of the window frame without affecting the watertightness of the sash window.

According to the present invention, a single sliding sash window including a fixed sash and a movable sash mounted within a window frame, comprises a generally inverted L-shaped mounting flange formed integrally with and extending longitudinally of sill of window frame, the mounting flange being disposed on the interior side of the window frame and including a vertical wing projecting from the sill and a horizontal wing supporting thereon a bottom rail of the fixed sash. One of opposed jambs of the window frame has a longitudinal guide groove sealingly receiving therein an abutment stile of the fixed sash. An upper attachment member extends between the opposite jamb of the window frame and a meeting stile of the fixed sash and is secured by thread fasteners to a head of the window frame. A lower attachment member extends between the opposite jamb and the meeting stile and is secured by thread fasteners to the horizontal wing of the mounting flange.

With this construction, the upper and lower attachment members serve to urge the abutment stile of the fixed sash into the longitudinal guide groove of the mating jamb. The attachment members themselves are firmly secured by the thread fasteners to the head and sill of the window frame. Thus, the fixed member is firmly held in position against displacement. Since the lower attachment member is not directly threaded to the sill of the window frame but threaded to the mounting flange on the sill, water is prevented from intruding through threaded holes into the building frame.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 4:
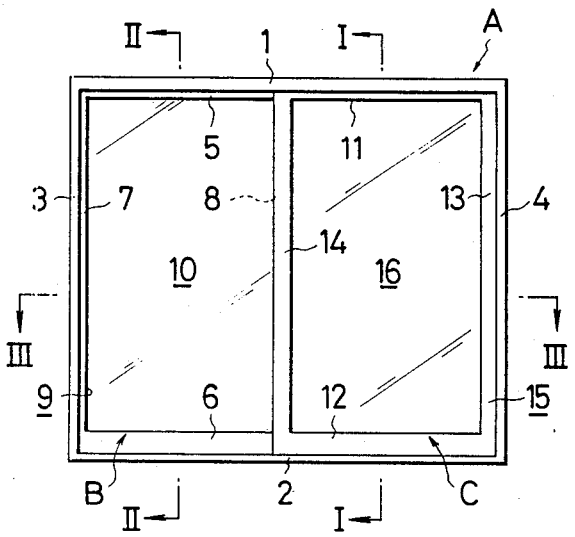
FIG. 4 is a schematic front elevational view of a single sliding ,sash window according to the present invention.
Figure 5:
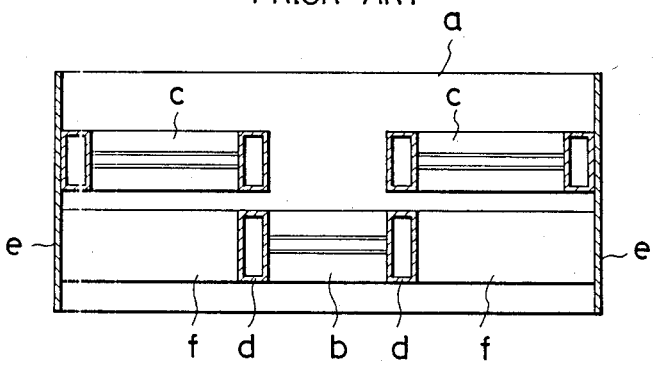
FIG. 5 PRIOR ART
FIG. 5 is a schematic front elevational view of a prior sliding sash window.

The principles of the present invention are particularly useful when embodied in a single sliding sash window such as shown in FIG. 4.

The single sliding sash window generally comprises a rectangular window frame A, a fixed sash B immovably mounted within the window frame A on the left side thereof and disposed on the interior side of the window frame A, and a movable sash C horizontally slidably mounted within the window frame A on the exterior side thereof. The window frame A includes a pair of horizontal pieces (head and sill) 1, 2 and a pair of vertical pieces (left and right jambs) 3, 4 connecting the head and the sill 1, 2. The fixed sash B includes a pair of horizontal pieces (top and bottom rails) 5,6 and a pair of vertical pieces (stiles) 7, 8 interconnecting the top and bottom rails 5, 6 to form a rectangular sash frame 9. The sash frame 9 has a rectangular opening closed by a pair of panes of glass 10. Likewise, the movable sash C includes top and bottom rails 11, 12 connected by left and right stiles 13, 14 so as to jointly form a rectangular sash frame 15. The sash frame 15 has a pair of panes of glass 16 closing a rectangular opening of the sash frame 15.

Figure 1:
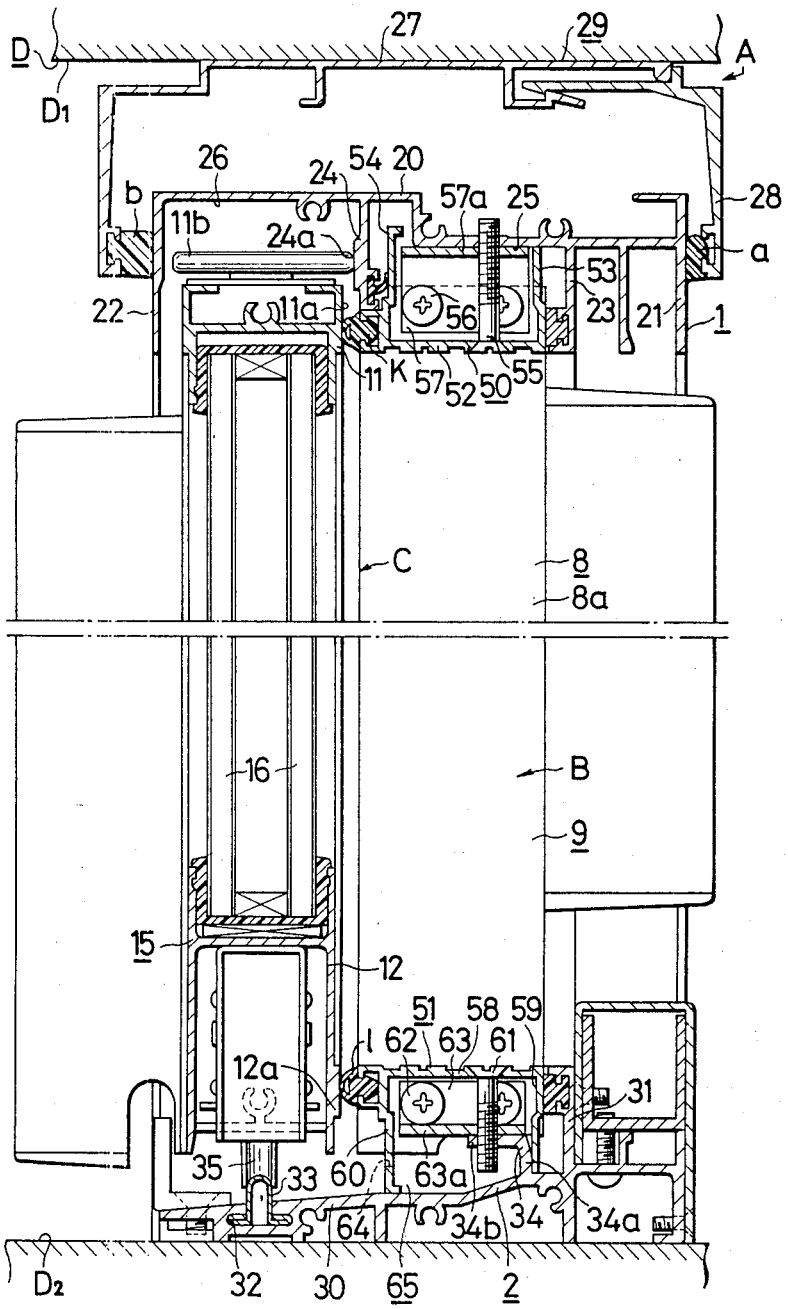
FIG. 1 is a vertical cross-sectional view taken along line I—I of FIG. 4.
Figure 2:
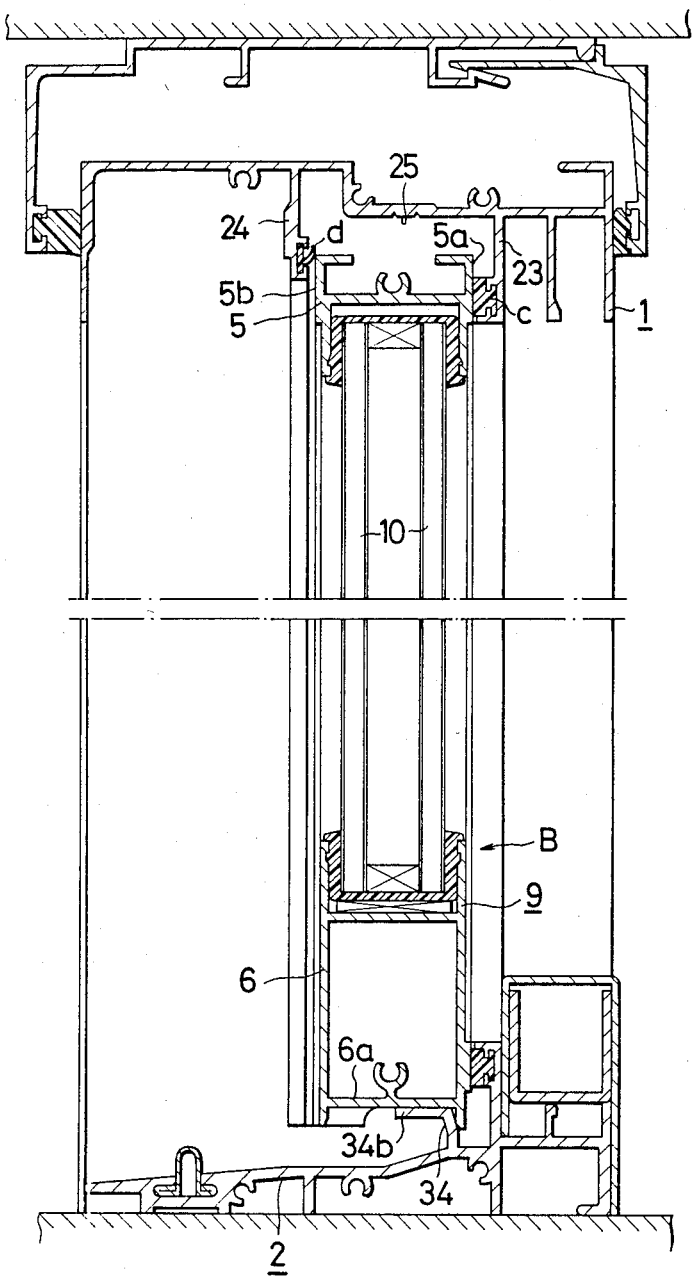
FIG. 2 is a vertical cross-sectional view taken along line II—II of FIG. 4.

The head 1 of the window frame A, as shown in FIGS. 1 and 2, includes a horizontal top wall 20, a pair of inner and outer vertical side walls 21, 22 extending integrally and downwardly from inner and outer longitudinal edges, respectively, of the top wall 20. The head 1 further has a pair of spaced intermediate support flanges 23, 24 disposed between the side walls 21, 22 and extending integrally and downwardly from the top wall 20, so that the head 20 has a downwardly opening interior groove 25 difined jointly by and between the top wall 20 and the first and second support flanges 23, 24 and a downwardly opening exterior groove 26 defined jointly by and between the top wall 20, the second support flange 24 and the outer side wall 22. The head 1 thus constructed is sealingly mounted on a channel-shaped head assembly 29, with two sealing strips a, b disposed between inner and outer vertical flanges of the assembly 29 and the inner and outer side walls 21, 22 of the head 1. The head assembly 29 is composed of a generally L-shaped body 27 secured to the top wall $D_1$ of a window opening D defined in a building frame, and an L-shaped presser strip 28 snap-fitted with the body 27.

As shown in FIG. 2, the top rail 5 of the fixed sash B is sealingly received in the interior groove 25. In this instance, two sealing strips c, d supported respectively on the support flanges 23, 24 sealingly engage interior and exterior surfaces 5*a*, 5*b* of the top rail 5.

The top rail 11 of the movable sash C, as shown in FIG. 1, is sealingly received in the exterior groove 26. The movable sash C includes at least one top roller 11*b* horizontally mounted on the top rail 11 and held in rolling engagement with a horizontal land 24*a* projecting from the second support flange 24 into the exterior groove 26.

The sill 2 of the window frame A, as shown in FIGS. 1 and 2, is formed of an extruded section and includes a bottom wall 30, an upstanding support flange 31 disposed on the interior side of the bottom wall 30 in substantially vertical alignment with the first support flange 23 of the head 20, and an inverted T-shaped groove 32 disposed on the exterior side thereof and extending in the bottom wall 30 parallel to the mounting flange 31. The groove 32 receives therein a guide rail 33. The sill 2 further has an inverted L-shaped mounting flange 34 formed integrally with the bottom wall 30 and disposed exteriorly of the upstanding support flange 31. The mounting flange 34 includes a vertical wing 34*a* extending upwardly from the bottom wall 30 and a horizontal wall 34*b* extending exteriorly from the top edge of the vertical wing 34*a*. The sill 2 is mounted on a bottom wall D2 of the window opening D.

As shown in FIG. 2, a bottom wall 6*a* of the bottom rail 6 of the fixed sash B is disposed on the horizontal wing 34*b* of the mounting flange 34. The movable sash C includes a plurality of rollers or runners 35 attached to the bottom rail 12 and rollingly mounted on the guide rail 33, as shown in FIG. 1.

Figure 3:
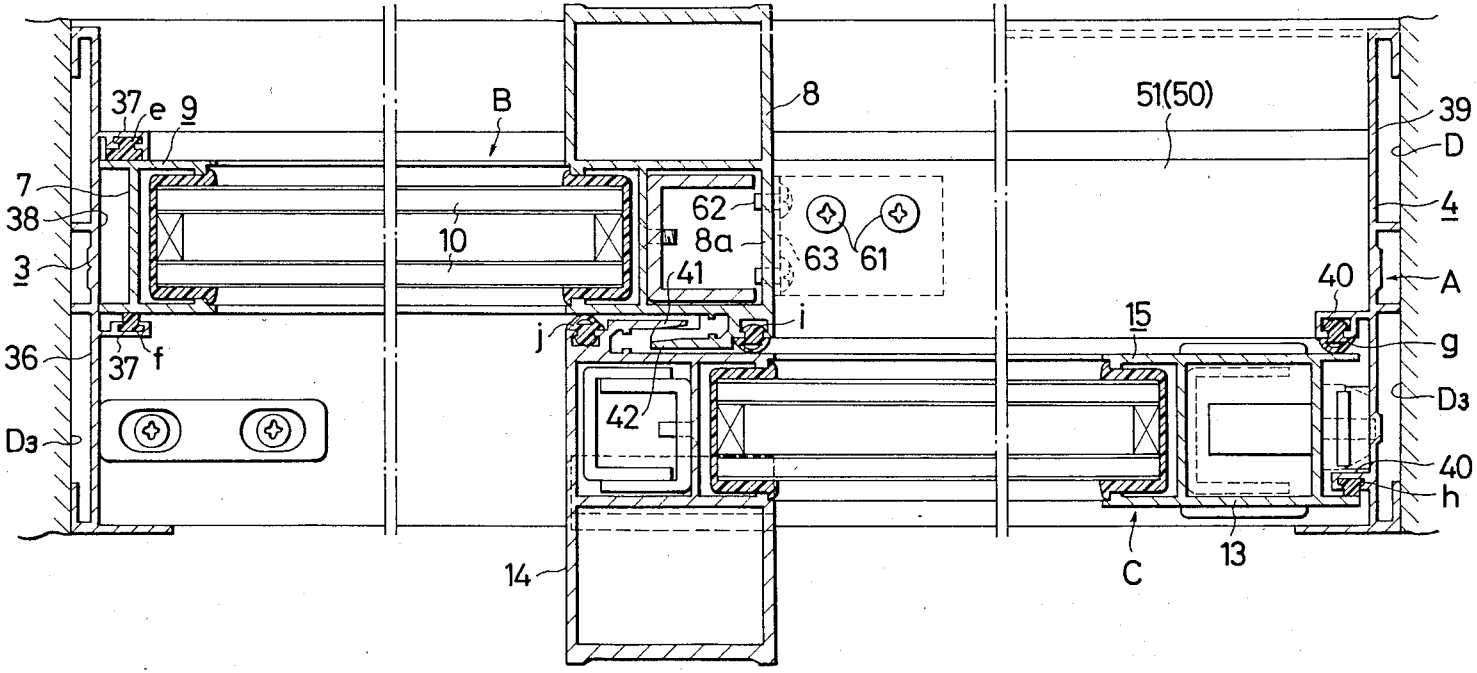
FIG. 3 is horizontal cross-sectional view taken along line III—III of FIG. 4.

The left jamb 3 of the window frame A, as shown in FIG. 3, includes a generally flattened channel-shaped body 36 and a pair of parallel spaced vertical support flanges 37, 37 disposed on the interior side of the body 36 and projecting from an inner surface of the body 36 so as to define therebetween a guide groove 38 in which the left stile (abutment stile) 9 of the fixed sash B is sealingly received, with a pair of sealing strips e, f projecting from the respective support flanges 37, 37 into sealing engagement with interior and exterior surfaces of the stile 9.

Likewise, the right jamb 4 of the window frame 3 includes a generally flattened channel-shaped body 39 and a pair of parallel spaced vertical support flanges 40, 40 disposed on the exterior side of the body 39 and projecting from an inner wall of the body 39 toward the left jamb 3. The support flanges 40, 40 have a pair of sealing strips g, h supported respectively thereon and sealingly engageable with interior and exterior surfaces of the right stile 13 when the right stile 13 is received between the support flanges 40, 40. The left and right jambs 3, 4 are attached to opposed vertical side walls D3, D3 of the window opening D.

The left stile (meeting stile) 14 of the movable sash C has a hook-shaped weatherseal fin 41 extending longitudinally therealong and sealingly engaeable with a hook-shaped weatherseal fin 42 of the right stile (meeting stile) 8 of the fixed sash B when the sash window is closed. A sealing strip i is attached to the meeting stile 8 at a position located exteriorly of the weatherseal fin 42 and sealingly engageable with the meeting stile 14. Likewise, the meeting stile 14 supports thereon a sealing strip j disposed exteriorly of the weatherseal fin 41 and sealingly engageable with the meeting stile 8 of the fixed sash B.

The window frame A includes a pair of upper and lower attachment members 50, 51 extending between an outer wall 8*a* of the meeting stile 8 and the body 39 of the right jamb 39. The upper attachment member 50, as shown in FIG. 1, is generally U-shaped including a horizontal bottom wall 52 and a pair of opposed vertical walls 53, 54 extending upwardly from opposite longitudinal edges of the bottom wall 52. The upper attachment member 50 is fitted in the interior groove 25 and then secured to the head 1 by a plurality of screws (only one shown) 55 threaded through the attachment member 50 into the top wall 20 of the head 1. An L-shaped upper bracket 57 is secured by a pair of screws 56 to the outer wall 8*a* of the meeting stile 8 of the fixed sash B. The bracket 57 has a horizontal arm 57*a* disposed flatwise against the top wall 20 and secured thereto by the screws 55. The exterior vertical wall 54 supports thereon a sealing strip k sealingly engageable with an interior surface 11*a* of the top rail 11 of the movable sash C, thereby providing a hermetic seal between the upper attachment member 50 and the top rail 11 when the movable sash C is opened.

The lower attachment member 51 also has a generally U shape including a horizontal top wall 58 and a pair of opposed vertical walls 59, 60 extending downwardly from opposite longitudinal edges of the top wall 58. The lower attachment member 51 is disposed on the body 30 of the sill 2 in such a manner that the interior vertical wall 59 is held in contact with the vertical wing 34*a* of the mounting flange 34. The lower attachment member 51 thus disposed is secured to the horizontal wing 34*b* by two screws 61 extending through the top wall 58 into the horizontal wing 34*b*. An L-shaped lower bracket 63 is secured by a pair of screws 62 to the outer wall 8*a* of the meeting stile 8. The bracket 63 has a horizontal arm 63*a* disposed on the horizontal wing 34*b* and secured thereto by the screws 61. The exterior vertical wall 60 supports thereon a sealing strip 1 sealingly engageable with an inner surface 12*a* of the bottom rail 12 so as to provide a hermetic seal between the lower attachment member 51 and the bottom rail 12 of the movable sash C when the movable sash C is opened.

The exterior vertical wall 60 of the lower attachment member 51 has at least one vent hole 64 through which an elongate space 65 defined jointly by and between the U-shaped lower attachment 61 and the body 30 is held in fluid communication with the atmosphere. With this pressure-equilibrium, water intruded through a clearance between the screws 61 and the top wall 58 into the elongate space 65 is drawn from the space 65 through the vent hole 64 to the outside of the sash window.

As described above, the abutment stile 7 of the sash frame 9 of the fixed sash B is stably received in the guide groove 38 in the left jamb 3 and urged against the left jamb 3 by means of the upper and lower attachment members 50, 51. The attachment members 50, 51 fixedly secured by the screws 55, 61 to the head 1 and the sill 2 is prevented from wobbling or removal relative to the window frame A even when subjected severe shock forces during repeated opening and closing operation of the sash window. Partly because of the form-locking engagement between the abutment stile 9 and the grooved jamb 3, and partly because of the firm attachment of the attachment members 50, 51 to the head 1 and the sill the sash frame 9 of the fixed sash B is firmly retained in position against displacement within the window frame A.

A further advantage is that the screws 61 used for securing the lower attachment member 51 is not threaded directly to the sill 2 but threaded into the horizontal wing **34*b* of the mounting flange 34 formed integrally with the sill 2**. With this indirect connection, water is prevented from intruding through screw threads into the building frame.

Obviously, various modifications and variations of the present invention are possible in the light of the above teaching. It is therefore to be understood that within the scope of the appended claims the invention may be practiced otherwise than as specifically described.

What is claimed is:

1. An improved single sliding sash window for buildings of the type including a fixed sash immovably mounted within a window frame adjacent to one jamb thereof and disposed on an interior side of the window frame, and a movable sash horizontally slidably mounted within the window frame on an exterior side thereof, wherein the improvement comprises:

(a) a generally inverted L-shaped mounting flange formed integrally with and extending longitudinally of a sill of the window frame, said mounting flange being disposed on the interior side of said window frame and including a vertical wing projecting from said sill and a horizontal wing extending from an upper end of the horizontal wing and supporting thereon a bottom rail of the fixed sash;

(b) means defining a guide groove extending longitudinally in said one jamb of the window frame and sealingly receiving therein an abutment stile of the fixed sash;

(c) an upper attachment member extending between the opposite jamb of the window frame and a meeting stile of the fixed sash and secured by thread fasteners to a head of the window frame; and (d) a lower attachment member extending between said opposite jamb and said meeting stile and secured by thread fasteners to said horizontal wing of said mounting flange.

2. An improved single sliding sash window according to claim 1, said lower attachment member having a generally inverted U-shape and disposed on said sill so as to conceal said mounting flange.

3. An improved single sliding sash window according to 2, including an L-shaped bracket secured to said meeting sile of the fixed sash and having a horizontal arm overlying said horizontal arm of said mounting flange and attached by said thread fasteners to said horizontal wing.

4. An improved single sliding sash window according to claim 2, said horizontal wing of said mounting flange being directed exteriorly of said window frame, said U-shaped lower attachment member including a horizontal top wall disposed above said horizontal wing, and a pair of interior and exterior vertical walls, said interior vertical wall being held in contact with said vertical wing of said mounting flange.

5. An improved single sliding sash window according to claim 4, said exterior vertical wall having a vent hole.

* * * * *